US008074623B2

(12) United States Patent
Carlsson et al.

(10) Patent No.: US 8,074,623 B2
(45) Date of Patent: Dec. 13, 2011

(54) METHOD FOR ADJUSTING THE AIR-FUEL RATIO OF AN INTERNAL COMBUSTION ENGINE

(75) Inventors: Bo Carlsson, Alingsås (SE); Niklas Enander, Göteborg (SE); Reine Gustafsson, Jönköping (SE); Mikael Larsson, Jönköping (SE); Mats Roberg, Huskvarna (SE)

(73) Assignee: Husqvarna AB, Huskvarna (SE)

( * ) Notice: Subject to any disclaimer, the term of this patent is extended or adjusted under 35 U.S.C. 154(b) by 246 days.

(21) Appl. No.: 12/300,310

(22) PCT Filed: May 12, 2006

(86) PCT No.: PCT/SE2006/000561
§ 371 (c)(1),
(2), (4) Date: Feb. 24, 2009

(87) PCT Pub. No.: WO2007/133125
PCT Pub. Date: Nov. 22, 2007

(65) Prior Publication Data

US 2010/0011597 A1 Jan. 21, 2010

(51) Int. Cl.
*F02D 41/10* (2006.01)

(52) U.S. Cl. ..... 123/436; 123/73 A

(58) Field of Classification Search ..... 123/333, 123/436, 437, 438, 701, 73 R, 73 A, 572, 123/481, 325; 701/103
See application file for complete search history.

(56) References Cited

U.S. PATENT DOCUMENTS

| | | | | |
|---|---|---|---|---|
| 4,434,768 | A * | 3/1984 | Ninomiya | 123/436 |
| 5,067,465 | A * | 11/1991 | Yamasaki et al. | 123/677 |
| 5,226,920 | A * | 7/1993 | Andreasson | 123/436 |
| 5,345,912 | A | 9/1994 | Svensson et al. | |
| 5,709,193 | A | 1/1998 | Svensson et al. | |
| 5,738,070 | A * | 4/1998 | Donaldson et al. | 123/352 |
| 5,809,971 | A | 9/1998 | Svensson et al. | |
| 6,880,812 | B2 | 4/2005 | Nonaka | |
| 6,978,666 | B1 * | 12/2005 | Wu et al. | 73/114.04 |
| 2001/0032601 | A1 * | 10/2001 | Galka et al. | 123/73 A |
| 2003/0172903 | A1 * | 9/2003 | Perez Carballo | 123/333 |

* cited by examiner

*Primary Examiner* — Mahmoud Gimie
(74) *Attorney, Agent, or Firm* — Novak Druce + Quigg LLP

(57) ABSTRACT

Method for adjusting the air-fuel ratio of an internal combustion engine, in a fuel supply section thereof, such as a carburettor or a fuel-injection system, the fuel supply section having a control unit for adjusting the air-fuel ratio of the engine, and the engine having an engine speed and an engine throttle ranging from zero throttle to full throttle. The method including: a) measuring the engine speed of the engine; b) comparing the engine speed to a first engine speed value; c) adjusting the air fuel ratio if the engine speed is lower than the first engine speed value; and d) repeating a) to c) until the engine speed is either greater than or equal to the first engine speed value.

33 Claims, 8 Drawing Sheets

Fig. 2a
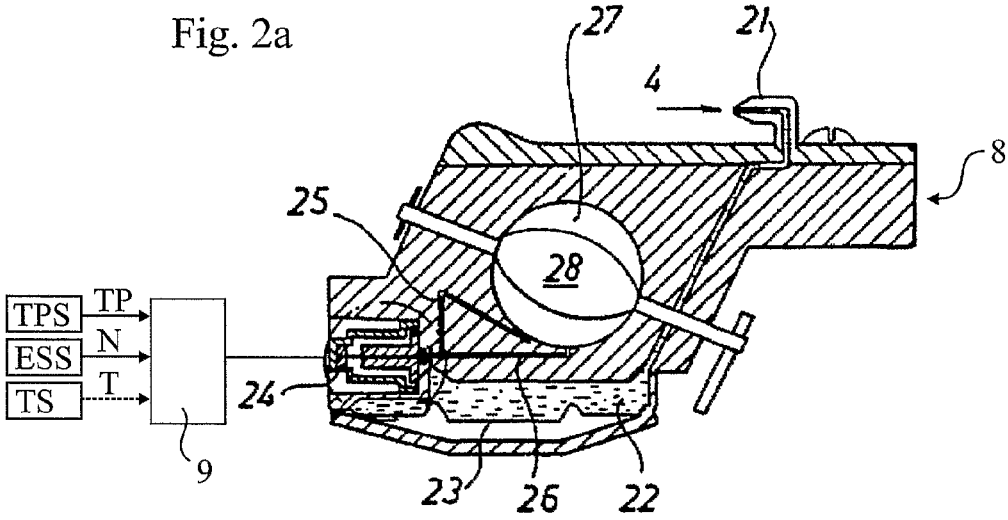
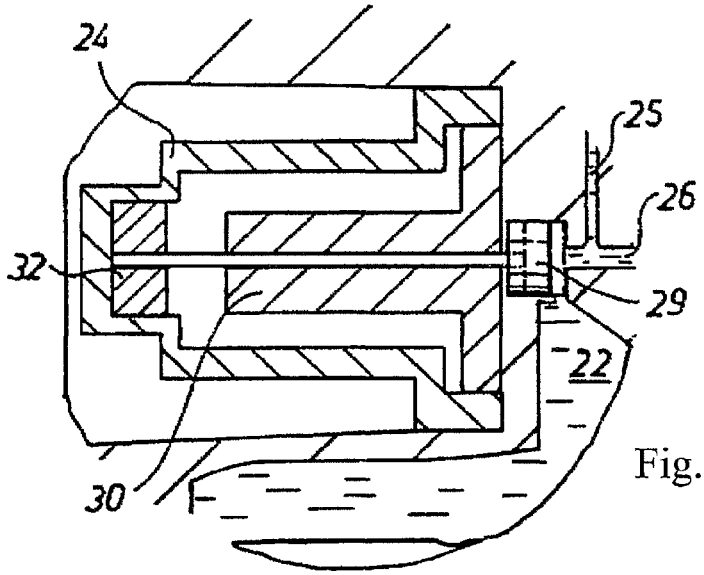
Fig. 2b

A/F Ratio Versus Engine Speed $$\text{rot. speed} = \frac{1}{\text{rev time}}$$

METHOD FOR ADJUSTING THE AIR-FUEL RATIO OF AN INTERNAL COMBUSTION ENGINE

TECHNICAL FIELD

The present invention relates to a method for adjusting the air-fuel ratio of an internal combustion engine, in a fuel supply section thereof, such as a carburettor or a fuel-injection system, the fuel supply section comprising means for adjusting the air-fuel ratio of the engine, the engine having an engine speed and an engine throttle ranging from zero throttle to full throttle.

BACKGROUND

In all internal combustion engines, IC engines, the air/fuel ratio is of utmost importance for the engine function. Usually the air/fuel ratio is referred to as the A/F-ratio, A and F signifying respectively air and fuel. In order to achieve a satisfactory combination of low fuel consumption, low exhaust emissions, good runability and high efficiency the A/F-ratio must be maintained within comparatively narrow limits.

The requirements that exhaust emissions from the IC engine to be kept low are becoming increasingly stricter. In the case of car engines these requirements have led to the use of exhaust catalysers and to the use of sensors and probes positioned in the car exhaust system in order to control the A/F-ratio.

However, for consumer products, such as power saws, lawn mowers, and similar products, this technology is difficult to use for mounting reasons and also for cost—efficiency and operational—safety reasons. For instance, in a power saw, a system with sensors and probes would result in increased size and weight as well as a drastic rise in costs and possibly also cause operational safety problems. Further the sensor or the probe often requires a reference having completely pure oxygen, which is a situation that it is practically impossible to achieve in some engines, for instance the motors of power saws.

Expected future legislation with respect to CO-emissions from small IC engines may make it difficult to use manually adjusted carburettors. Given the manufacturing tolerances that could be achieved in the case of carburettors it is impossible, with the use of fixed nozzles in the carburettor, to meet these legal requirements and at the same time guarantee the user good runability in all combinations of air-pressures and temperatures, different fuel qualities and so on.

EP 0 715 686 B1 describes a method of controlling the engine A/F-ratio without the use of an oxygen sensor (lambda probe). Initially, the A/F-ratio is changed briefly. This could be effected for instance by briefly throttling or stopping the fuel supply. In connection with the change, a number of engine revolution times are measured. The revolution times relate to engine rotational speeds chosen in such a manner that at least one revolution of the engine is unaffected by the change, preferably an engine rotational speed that is sufficiently early for the A/F-ratio change not having had time to affect the engine rotational speed. Further at least one forthcoming revolution of the engine is chosen in such a manner that it is affected by the brief A/F-ratio change. In this manner it becomes possible to compute a revolution-time difference caused by an A/F-ratio change. On the basis of this revolution-time difference a change, if needed, of the mixture ratio in the desired direction towards a leaner or richer mixture is made. Thus using this method an optimal mixture can be achieved by testing how the engine reacts to a leaner or richer mixture.

However, the engine control method of EP 0 715 686 B1 is somewhat slow and it would therefore be advantageous if it could be speeded up. For instance if the present A/F ratio comes far off from the desired A/F ratio it would be an advantage if the starting A/F-ratio could be fast-forwarded to a position closer to the desired A/F-ratio before the control method of EP 0 715 686 B1 steps in.

Further, in the context of the application an engine is said to be idling when the engine is running at zero throttle. If the engine is too lean at start it may operate when it is idling, but failing to accelerate to working speed when the throttle is set to full. This may be a problem for a control method active only when at working speed.

When starting the engine at a given fuel supply setting, the corresponding A/F ratio could be affected by a number of factors. For instance if the engine is used in a smoky and hot environment, e.g. as rescue equipment in a fire, providing a high temperature and a deteriorated air quality. But also factors as outside air-pressure and moisture content as well as engine wear, fuel quality and the condition of the air-filter influences the corresponding A/F ratio. Of course having additional sensors could to some extent compensate for such factors, but more sensors increases costs as well as size and weight of the engine, all preferred to be kept at minimum.

Further, in most engines for a power saw, a power cutter, a lawn mover and similar consumer products, the A/F ratio is manually controlled when the engine is idling, e.g. the electronic control system is only active when the engine is at working speed or above. It would therefore be desirable to have a simple, non-expensive but efficient electronic control method, without the need of adjusting the fuel or air supply manually, when the engine is idling.

The situation when the engine is operated at full throttle and at the same time not subjected to any load (other than inevitable friction within the machine comprising the engine) is in the context of the application denoted as a free speed situation and the engine reaches high engine speeds when free speeding. In the prior art it is known to control the A/F-ratio so that the desired A/F-ratio is defined as the A/F-ratio when the engine has reached its maximum engine speed. However, the engine wear is increased with higher engine speeds and higher speeds may result in damages to the engine and a reduced expected service life of the engine.

OBJECT OF THE INVENTION

An object of the invention is to provide a engine control method which quickly find a feasible full throttle A/F-ratio of the engine.

A further purpose of the invention is to provide an engine control method preventing the engine from overspeeding when the engine is free speeding.

A further purpose of the invention is to detect if the engine has lean A/F ratio, in particular at start up.

A further purpose of the invention is to provide a control method when the engine is running at zero throttle, i.e. idle speed.

A further purpose of the method is to provide a method for telling the engine to start a calibration scheme.

SUMMARY OF THE INVENTION

The purpose of the subject invention is to considerably reduce the problems outlined above by providing a method for controlling the fuel and/or air supply to an internal combustion engine in the fuel supply section thereof, such as a carburettor or a fuel-injection system, the fuel supply section comprising means for adjusting the air-fuel ratio of the engine, the engine having an engine speed and an engine throttle ranging from zero throttle to full throttle, the method comprising the steps of:

a) measuring the engine speed of the engine,
b) comparing the engine speed to a first engine speed value
c) if the engine speed is lower than the first engine speed value; the air-fuel ratio is adjusted,
d) repeating step a) to c) until the engine speed is larger than or equal to the first engine speed value.

And where the method further comprising the steps:

e) comparing the engine speed to a second engine speed value, the second engine speed value arranged to be larger than the first engine speed value,
f) if the engine speed is higher than the second engine speed value; the air-fuel ratio is adjusted.
g) repeating step a) to step f) until the engine speed is in the range of the first and second engine speed values.

Preferably the engine uses a rich fuel setting when started, the rich start setting providing an air-fuel ratio believed to be richer than the A/F ratio corresponding to the first engine speed value. The rich fuel start setting can be based on a predetermined stored value, but may also be based on a stored variable setting, the second setting adapted to the latest engine run. By providing a rich fuel start setting the air-fuel ratio adjustment of step c) can be performed by increasing the air-fuel ratio, i.e. providing a leaner mixture. For step f) the air-fuel ratio adjustment of step f) can then be performed by decreasing the air-fuel ratio, i.e. providing a richer mixture. By "knowing" that the mixture is either rich or lean, the engine speed interval defined by the first and the second engine speed values can be quickly found.

In an engine where the fuel is crankcase scavenged a leaner mixture can be provided by shutting off partly or completely the fuel supply during a number of engine revolutions in a long period of revolutions.

However, in a direct injection engine a leaner mixture will be provided by shortening every injection.

According to further aspects the second engine speed value is between 10-500 rpm larger than the first engine speed value, preferably 100-200 rpm larger.

The measured engine speed is preferably derived by averaging the engine speed over at least two revolutions, preferably at least 10 revolutions.

According to the invention the method is used for free speed control in a free speed situation indicated by at least two conditions; 1) full throttle of the engine (1) and 2) that the measured engine speed is larger than a free speed threshold, preferably the free speed threshold is at least 10 000 rpm. And where a third condition for performing the free speed control is that the engine speed has not during the ongoing engine run fulfilled the free speed regulating conditions. It is moreover preferred during free speed control that the engine speed value(s) are set to be lower than a maximum engine speed value, thereby also enabling an overspeed control, where the maximum engine speed value is defined as the engine speed when the engine is running at an air-fuel ratio optimised for maximum engine speed.

According to the invention the method can also be used for idle speed control of the engine, determining an idle speed air-fuel ratio. The idle speed control is performed when the engine throttle is at zero throttle.

According to the invention a lean prevention control is also provided, where the engine (1) is considered running lean if at least the following conditions are met: 1) the throttle position is full, 2) the measured engine speed is lower than a lower work threshold, preferably the lower work threshold is lower or equal to 120 rps, more preferably lower or equal to 100 rps 3) the trend of the engine speed is decreasing. Preferably the trend of the of the measured engine speed is derived over a number of revolutions, where the number of revolutions are within the interval 2-100 revolutions, preferably within 5-50 revolutions, more preferably 10-30 revolutions.

According to a preferred embodiment of the invention the lean prevention control is active only during a start up sequence of the engine, the start up sequence determined by at least one of the following conditions: 1) that the number of revolutions from start is lower than a first start up condition value, where preferably the first start up condition value is lower than 1000 revolutions, more preferably lower than 500 revolutions, even more preferred lower than 100 revolutions, 2) that the time from start is shorter than a second start up condition value, preferably the second start up condition value is in the range of 1-30 seconds, 3) that a number of separated full throttle indications from start are lower than a third start up condition value, 4) that an accumulated time of full throttle from start is shorter than a forth start up condition value.

Further the invention includes an engine control method comprising a test based control essentially defined by a brief fuel shut-off and measurement of a number of revolutions in connection with the brief shut-off followed by an adjustment of the fuel amount based on the effect of the brief shut-off, the adjustment is usually performed after an aggregation of a number of shut-offs. The test based control is combined with at least one of the following control methods: 1) the free speed control 2) the idle speed control 3) the lean prevention control according. In an engine where the fuel is crankcase scavenged the brief fuel shut-off can last for one or a few engine revolutions. In an engine with direct fuel injection the test based control is instead based on a shortened fuel injection during one or a few engine revolutions.

Further a calibration method for a hand held working tool comprising a centrifugal clutch driving a cutting device is provided including a calibration mode for calibrating engine settings the calibration mode is initiated by the following steps: 1) blocking the cutting equipment, 2) starting the engine, 3) activating full throttle at least two separated times providing for at least two full throttle indications, the full throttle indications within a predetermined time period.

Further a finished calibration is communicated to the user through an oscillation of the engine speed.

Further if the hand held working tool is a chainsaw, the blocking of the cutting equipment is performed by activating the chain brake.

BRIEF DESCRIPTION OF THE DRAWINGS

The invention will be described in the following in closer details by means of various embodiments thereof with reference to the accompanying drawings wherein identical numeral references have been used in the various drawing figures to denote corresponding components.

FIG. 2*a* illustrates schematically a carburettor intended to be incorporated in a fuel supply system in accordance with the invention.

FIG. 2*b* is in a part enlargement of an area illustrated in FIG. 2*a* by means of dash- and dot lines.

DETAILED DESCRIPTION OF THE INVENTION

The present invention concerns crankcase scavenged two- or four-stroke engines and any references to engines in the following description concerns these type of engines.

Figure 1:
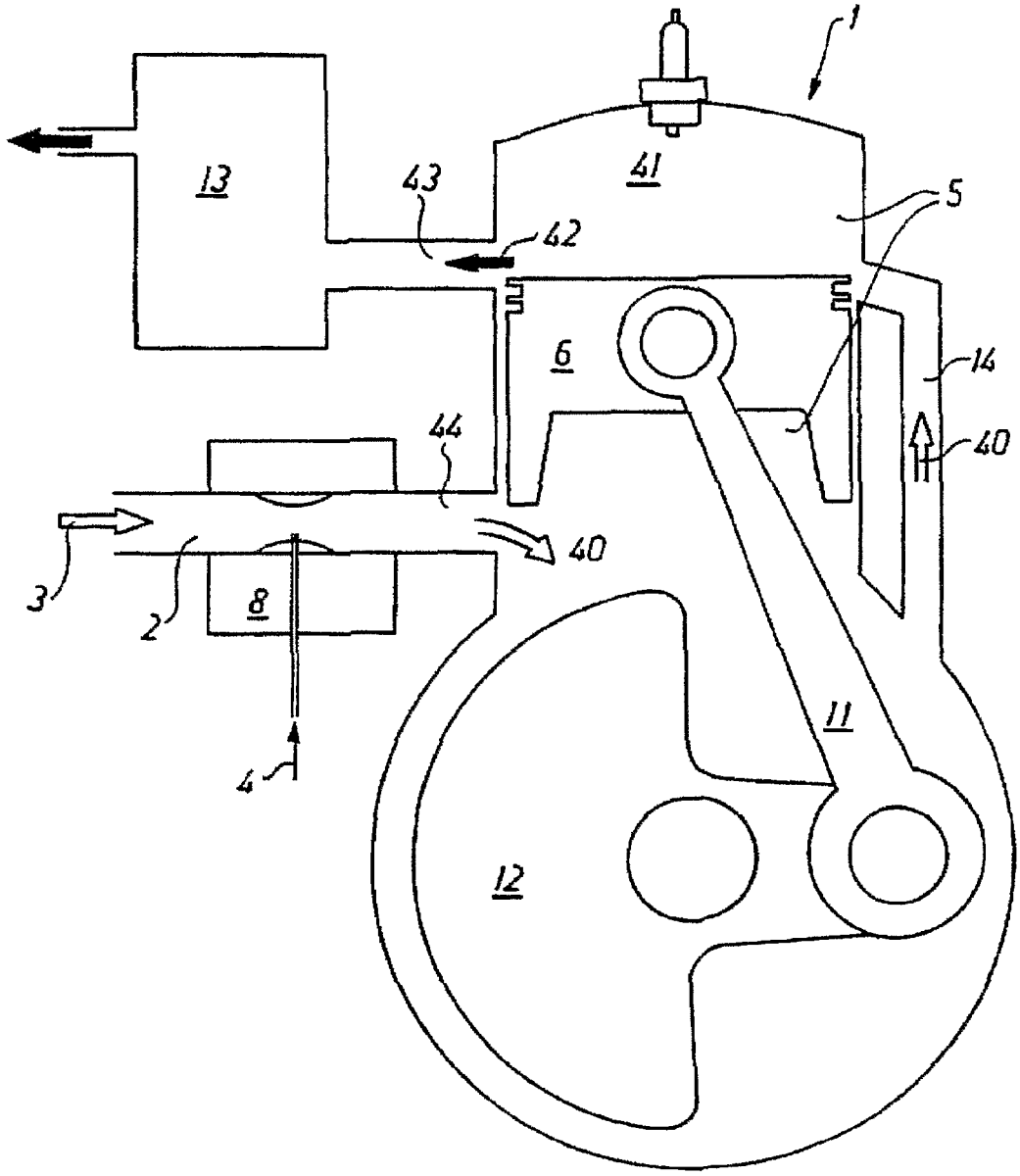
FIG. 1 is a schematically illustration of an internal combustion engine of two-stroke type in which the method and the device according to the invention have been applied.

In the schematically illustrated drawing FIG. 1 numeral reference 1 designates an internal combustion engine of a two-stroke type. It is crankcase scavenged, i.e. normally a mixture 40 of air 3 and fuel 4 with lubricant from a fuel supply system 8 (e.g. a carburettor or a low pressure fuel injection system) is drawn to the engine crankcase. From the crankcase, the mixture is carried through one or several scavenging passages 14 up to the engine combustion chamber 41. However, in other feasible engine designs—two-strokes or four-strokes—only the air and lubricant can be crankcase scavenged, or maybe only the air is crankcase scavenged. It is also possible to crankcase scavenge only a part of either the air, or the air plus lubricant, or the air plus fuel plus lubricant. The chamber is provided with a spark plug igniting the compressed air-fuel mixture. Exhausts 42 exit through the exhaust port 43 and through a silencer 13. All these features are entirely conventional in an internal combustion engine and for this reason will not be described herein in any closer detail. The engine has a piston 6 which by means of a connecting rod 11 is attached to a crank portion 12 equipped with a counter weight. In this manner the crankshaft is turned around. In FIG. 1 a piston 6 assumes an intermediate position wherein flow is possible both through the intake port 44, the exhaust port 43 and through the scavenging passage 14. The mouth of the intake passage 2 into the cylinder 5 is called intake port 44. Thus the intake passage is closed by the piston 6. By opening and closing the intake passage 2 varying flow speeds and pressures are created inside the passage. These variations largely affect the amount of fuel 4 supplied when the fuel supply system 8 is of carburettor type. Since a carburettor has an insignificant fuel feed pressure, the amount of its fuel feed is entirely affected by pressure changes in the intake passage 2. The supplied amounts of fuel are essentially affected by the varying flow speeds and pressures inside the intake passage that are caused by the opening and the closing of the latter.

FIG. 2*a* illustrates a fuel supply system 8 of carburettor type in accordance with the invention and FIG. 2*b* is a part enlargement of an area illustrated in FIG. 2*a* by means of dash- and dot lines. Supply of fuel 4 is affected to fuel nipple 21 on a carburettor. The carburettor is a conventional membrane carburettor and will therefore only be briefly described. Also other types of carburettors that are arranged to supply fuel in a similar manner for further treatment are possible. From the fuel nipple 21 fuel is carried to a fuel storage 22 which is delimited downwards by a membrane 23. From the storage 22 a line leads to a shut-off valve 24. The latter is in the form of a solenoid or electromagnet. Upon energization, the shut-off valve 24 closes off the interconnection between the storage 22 and the fuel lines 26, 25 leading to the venturi 27 in the carburettor, by forcing a closure plunger 29 forwards. The closure plunger 29 is attached to a piston rod travelling in a guide 30 and at the opposite face of the piston rod is arranged e.g. an iron core which is attracted by an energized coil so as to be moved outwards. In other words, the solenoid is of a normally open type. However, it goes without saying that it could also be of a normally closed type. In the latter case the shut-off valve 24 opens up the fuel passage as the solenoid is energized. The smaller channel 25 leads to the venturi 27 and is used as a so called idling nozzle whereas the coarser channel 26 also leads to the venturi 27 and is used as the principal nozzle. The throttle valve 28 is normally when operated either fully opened, i.e. "full throttle", or closed, i.e. "zero throttle". When closed the fuel supply is drawn from the idling nozzle and when open fuel supply is drawn from both the idling nozzle and the principal nozzle, however the fuel supply from the principal nozzle is substantially larger and the idling nozzle hardly affects the fuel supply during full throttle. An engine control unit 9 controls the shut-off valve 24 to be opened or closed, thereby controlling the fuel supply of the engine 1. According to the invention the control of the shut-off valve 24 may very well be different when on "full throttle" compared to "zero throttle", i.e. the throttle position may not only affect the air flow through the venturi 27 and which nozzle(s) to be used, but may also provide inputs to the control unit 9 on how and when the shut-off valve 24 should be opened or closed. The control unit 9 receives input parameters such as throttle position TP from the throttle positions sensor(s) TPS, engine speed N from the engine speed sensor (s) ESS, and optionally a temperature T from a temperature sensor(s) TS. Usually a temperature sensor measures the ambient temperature and transmits signals through a cable to an electronic circuit board. However, instead it is possible to integrate the temperature sensor directly on the electronic circuit board. Thereby a connecting cable can be avoided improving reliability and cost efficiency. Further the circuit board can be located close to the fuel supply section 8 and thereby experience its temperature, e.g. temperature after a stop influencing next start of the engine. Of course further sensor inputs could be used. The control unit 9 uses these inputs to decide how much fuel should be supplied to the engine 1 by opening or closing the shut-off valve 24. According to the invention several methods are proposed, on how to find a desired A/F ratio during operation of the engine. These methods could be used independently or together.

Figure 4:
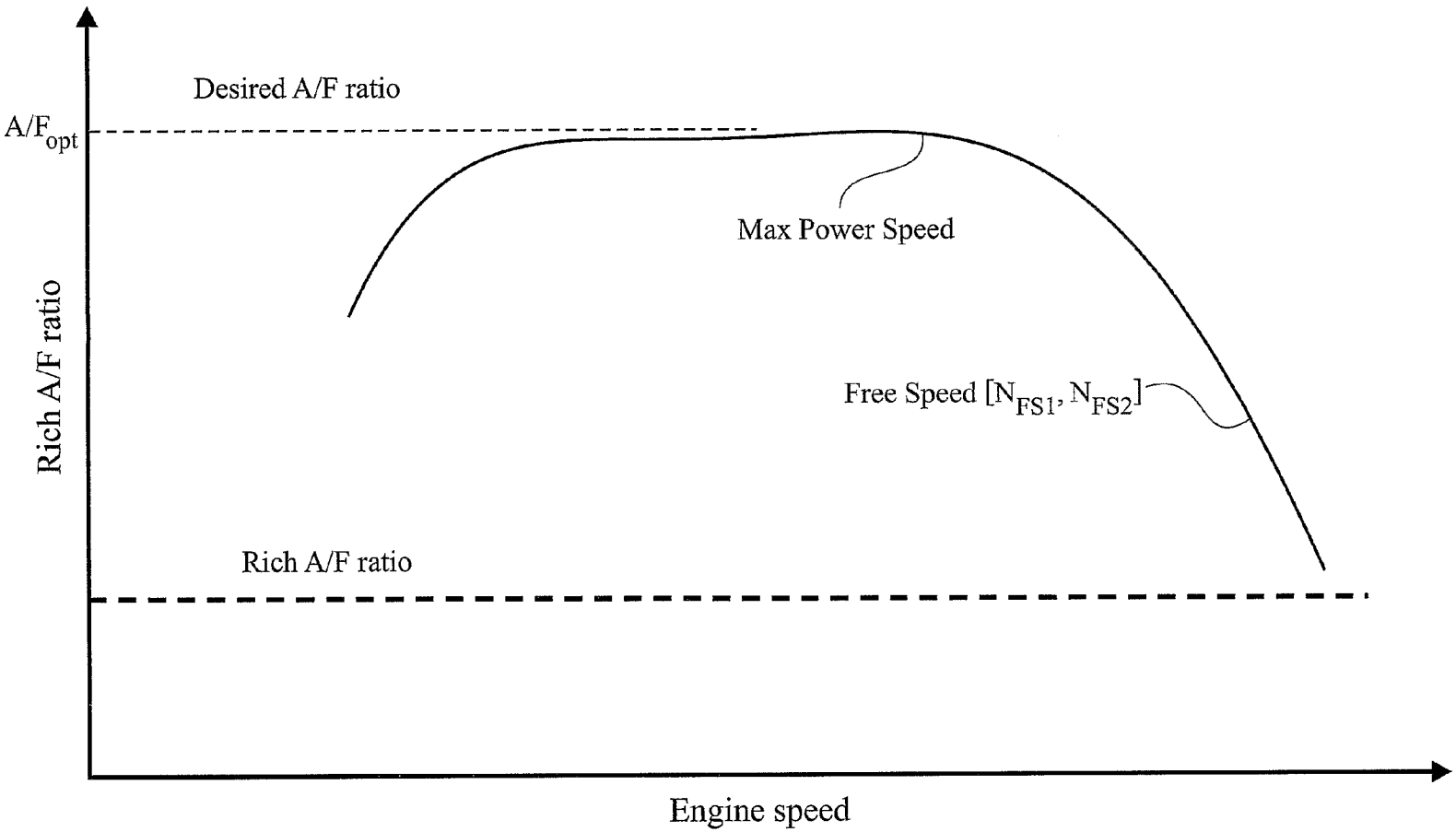
FIG. 4 illustrates the air-fuel ratio A/F as a function of the number of engine revolutions in a carburettor engine.

The engine of FIG. 1 and the fuel supply system 8 of FIG. 2*a* and FIG. 2*b* are incorporated in the description in order to clarify the invention. There are several factors affecting the A/F ratio of the engine. The fuel supply to the engine can be controlled by partly or completely closing/opening the shut-off valve 24, for a series of revolutions or periodically according to a fuel control scheme, this scheme may be different when the engine is at full throttle or zero throttle. E.g. the control unit 9 can control the fuel supply to the engine 1 by opening and closing the shut-off valve 24, partly or completely, during an engine revolution, where a fuel control sequence determines which revolutions the fuel supply of the engine will be partly or completely shut-off during a period of revolutions. Further, for carburettor engines, the A/F ratio is also dependent of the engine speed N affecting the pressure in the intake passage, this dependency of the engine speed can also be adjusted by engine mapping, e.g. the fuel control scheme can be adjusted for engine speed N. FIG. 4 shows an example of how the A/F ratio changes as with the engine speed N.

The engine speed N can e.g. be derived by measuring the time period between two consecutive ignitions or measuring the rotational speed of the crankshaft. Further in the context of this application the engine speed N could also be an average over several revolutions.

Figure 3:
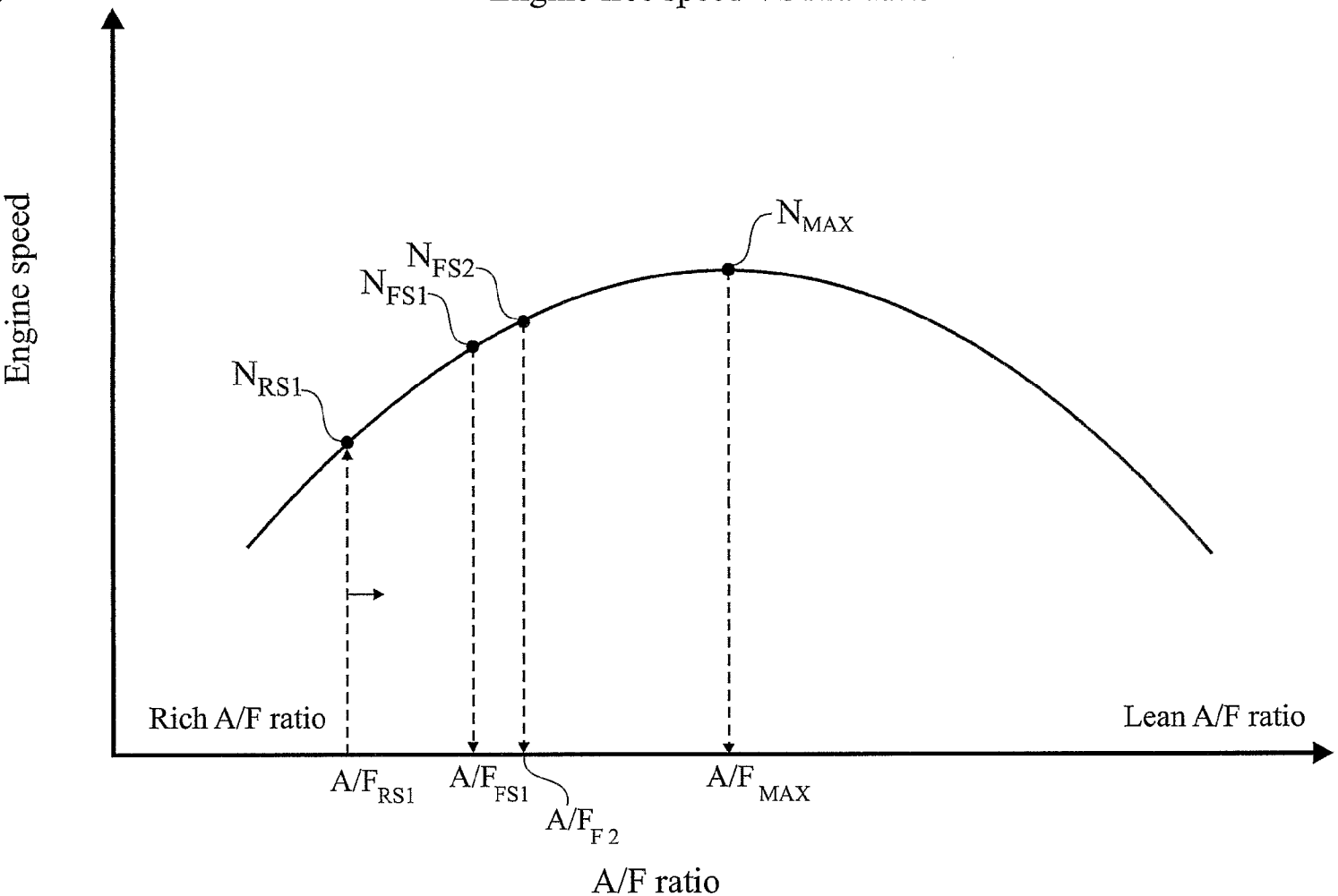
FIG. 3 illustrates how the engine free speed varies over the A/F-ratio.

FIG. 3 shows a diagram on how the engine free speed varies over the A/F-ratio. Engines in many working tools as for instance chainsaws and power cutters are normally run at either full throttle or zero throttle. When the engine is running at full throttle but without any work load the engine is said to be free speeding. When free speeding the engine reaches its highest engine speeds. The left part of the diagram shows the engine having a rich mixture, i.e. the relative amount of fuel is comparably high, and the right part of the diagram shows the engine having a lean mixture, i.e. the relative amount of fuel is comparably low. When the engine speed N has its peak $N_{MAX}$ the corresponding air-fuel mixture $A/F_{MAX}$ is said to be neither rich nor lean; the engine has its optimum-power position. Moving from $A/F_{MAX}$ towards a richer or leaner mixture provides for lower engine speeds N. Normally, when an engine starts, the engine runs somewhat lean before the engine has warmed up and reached its operating temperature. In order for the engine to warm up it is common for working tools, such as chainsaws and power cutters, to run the engine at full throttle without any work load a couple of times before using the engine in a work load situation. According to the invention this warm up of the engine is used to quickly find a basic setting of the A/F ratio. The principle of finding the basic setting is to start the engine with a full throttle rich fuel supply setting RS1 providing a rich starting air-fuel mixture $A/F_{RS1}$. The full throttle rich fuel setting RS1 could e.g. be affected by a fuel control scheme in the control unit 9 as described above. There are of course a number of ways on how to determine a satisfactory full throttle rich fuel setting RS1, for instance it could be a fix machine setting or decided from the engine performance in previous engine runs. After starting the engine the rich air-fuel mixture $A/F_{RS1}$ provides for a corresponding engine speed $N_{RS1}$ when the engine is run at full throttle without any work load. By gradually decreasing the fuel supply, controlled by the control unit 9, the air-fuel mixture becomes leaner and the A/F ratio moves towards right in the diagram. As the air-fuel mixture becomes leaner the engine speed N increases, assuming that the rich starting air-fuel mixture $A/F_{RS1}$ really started at the rich side of the diagram. According to the invention a first engine free speed value $N_{FS1}$ and a second engine free speed value $N_{FS2}$ provides an engine free speed range $[N_{FS1}, N_{FS2}]$. Further, the engine free speed range $[N_{FS1}, N_{FS2}]$ is chosen as to be lower than the maximum engine speed $N_{MAX}$ and this engine free speed range $[N_{FS1}, N_{FS2}]$ is sought shortly after the start of the engine by adjusting the A/F ratio. As can be seen in the diagram $N_{RS1}$ is arranged to be below the engine free speed range $[N_{FS1}, N_{FS2}]$, by choosing a full throttle rich fuel setting RS1 believed to provide for a rich starting air-fuel mixture $A/F_{RS1}$, richer than the A/F ratio interval $[A/F_{FS1}, A/F_{FS2}]$ corresponding to the engine free speed range $[N_{FS1}, N_{FS2}]$. Thus according to the invention the engine is started at a full throttle rich fuel setting RS1, providing the engine with an extra supply of fuel during the first cycles of revolutions from start up of the engine; and while free speeding the air-fuel mixture is step by step adjusted preferably by decreasing the fuel supply of the engine, till the engine speed N reaches the free speed range $[N_{FS1}, N_{FS2}]$. Further, the engine free speed range $[N_{FS1}, N_{FS2}]$ also functions as an overspeed limiting control preventing the engine to reach its maximum speed $N_{MAX}$ when free speeding. Of course it may happen that the full throttle rich fuel setting RS1 fails to provide for a richer starting air-fuel mixture $A/F_{RS1}$; depending of factors such as temperature, oxygen content in the air, air pressure, condition of the air filter and fuel quality; the curve of the diagram may change and/or the full throttle rich fuel setting RS1 may provide a lean air-fuel mixture. To avoid this, the full throttle rich fuel setting RS1 is preferably provided with a safety margin reducing the risk that the corresponding rich air-fuel mixture $A/F_{RS1}$ ends up leaner than the A/F ratio interval $[A/F_{FS1}, A/F_{FS2}]$. However even if the rich air-fuel mixture $A/F_{RS1}$ should end up too lean, the control method could be provided with measures detect such a situation and accordingly enrich the mixture and possible adjust the full throttle rich fuel setting RS1 till the next engine run. Of course the control unit 9 could be provided with a reset function allowing the full throttle rich fuel setting RS1 to be reset to a default value.

Further, according to the invention a calibration mode for the engine could be implemented in the control unit 9. In calibration mode the engine is runs a calibration scheme and calibrates engine control settings in the control unit 9, e.g. finding a proper full throttle rich fuel setting RS1. Firstly, the engine is set to calibration mode. To set the engine in calibration mode, a calibration button, which is pressed to start the calibration scheme, could be provided. However, providing further components to the apparatus comprising the engine increases costs and weight and is also not desirable for sizing reasons. According to the invention the calibration mode for a chainsaw is instead communicated to the control unit 9 by a method comprising the following steps: 1) Activate the chain brake, 2) Start the engine, 3) Quickly press for full throttle a number of separated times, e.g. 5 times in a row, each pressing during a short time period and the following pressing within a short time period. Since the chain brake is activated; the engine speed N will reach a clutch slipping speed. By sensing that the clutch slipping speed has been reached a number of times in a row a distinct signal has been achieved. This distinct behaviour of the engine speed N is detected by the control unit 9 to set engine in calibration mode. Now the engine is set to calibration mode. To start the calibration scheme the chain brake is released and full throttle is pressed until the engine signalises back to the user that the calibration scheme is finished. Thus after the calibration mode has been communicated the calibration scheme is run, e.g. by free speeding the engine where the engine starts very rich and thereafter gradually making the mixture leaner, passing the maximum speed $N_{MAX}$ and recording the corresponding fuel setting; the procedure is then reversed moving from a lean setting towards a rich setting, passing the maximum speed $N_{MAX}$ and recording the corresponding fuel setting. In a similar way the fuel setting corresponding to the engine free speed range $[N_{FS1}, N_{FS2}]$ could be found. Based on this information the full throttle rich fuel setting RS1 can be set as well as other settings. This calibration scheme is provided as an example; naturally a wide variety of methods could be implemented to calibrate the engine settings. When the calibration scheme has finished the engine communicates back to the user that the calibration scheme is finished, e.g. by oscillating the engine speed N heavily. Of course other distinct changes in the engine speed N could be used to communicate to the user that the calibration is finished. When the user feels or hears the oscillating engine speed he knows that the calibration is finished and can release the throttle actuator.

FIG. 4 illustrates the air-fuel ratio A/F as a function of the number of engine revolutions in a carburettor engine. The A/F ratio of a carburettor engine running on full throttle is mainly dependent of two factors; 1) the engine speed N and 2) the fuel supply to the intake passage 2 of the engine 1. The fuel supply to the intake passage 2 can be partly limited or in the case of crankcase scavenged engine be periodically completely shut-off; since the crank case in crank case scavenged engines can hold a considerable amount of fuel and consequently serve as a levelling reservoir, it is not necessary to adjust the fuel supply for each revolution, i.e. adjusting the fuel supply in one revolution will affect the subsequent revolutions. The engine speed N also affects the A/F ratio, the amount of the fuel feed is entirely affected by pressure changes in the intake passage 2 which is dependent of the engine speed N. Thus reducing the engine speed N provides a leaner mixture if not compensated for otherwise. This effect is engine dependent but can also be adjusted for by the control system of the engine, e.g. by engine mapping. According to the invention the sought free speed range [$N_{FS1}$, $N_{FS2}$] of the free speed control is arranged to correspond to a leaner desired air-fuel mixture $A/F_{opt}$, in a working condition at a lower working speed, the desired air-fuel mixture $A/F_{opt}$, close to the optimum-power position of the A/F ratio. Thus when the engine is free speeding the engine runs on a somewhat rich setting, but when the engine has a working load the A/F ratio moves towards an optimum-power position. However when the engine working under load further fine tuning of the A/F ratio is preferably made (e.g. the test based control of FIG. 8); thus the free speed range [$N_{FS1}$, $N_{FS2}$] is used to quickly find a feasible A/F ratio.

Figure 5:
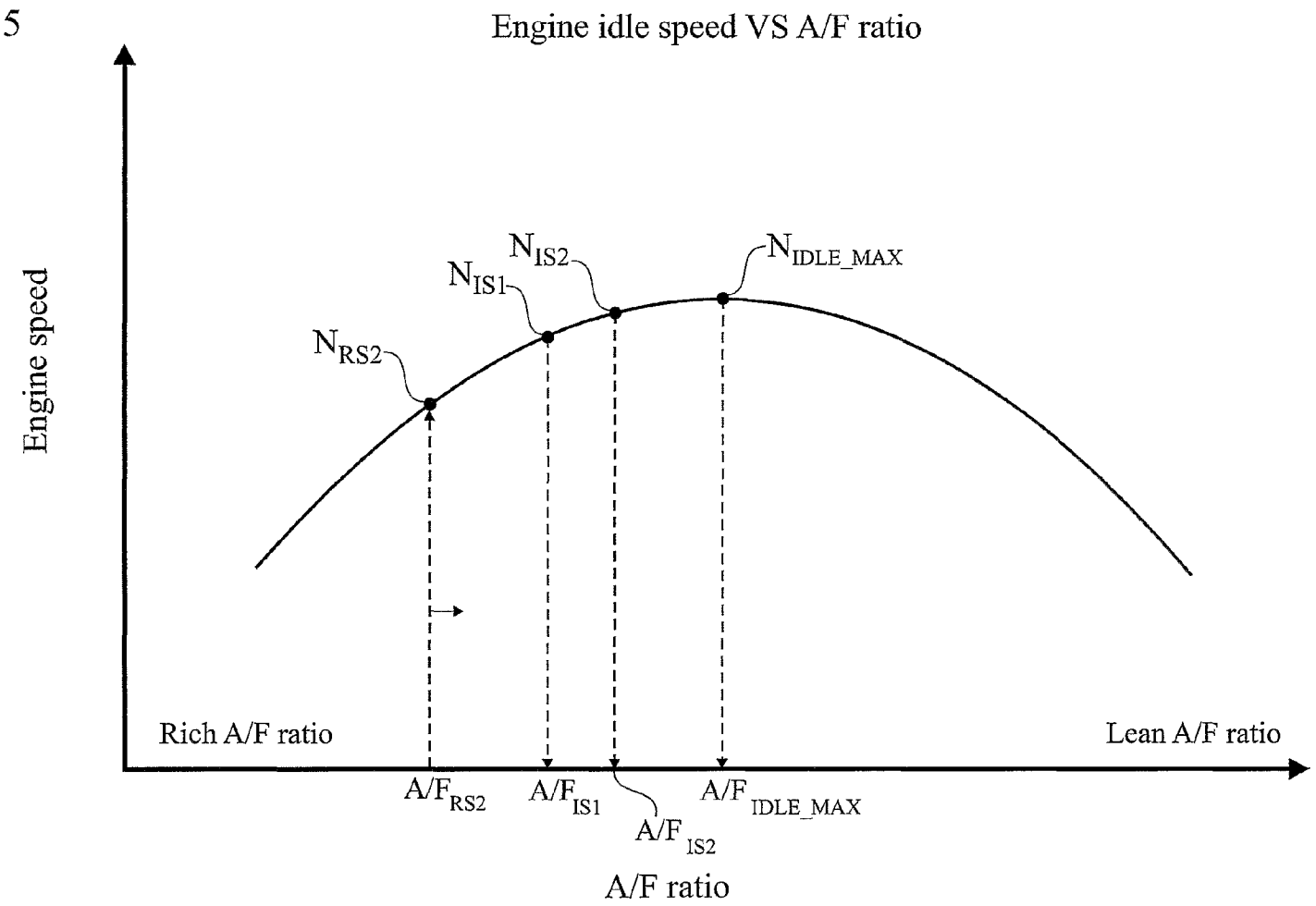
FIG. 5 illustrates how the engine idling speed varies over the A/F-ratio.

FIG. 5 illustrates how the engine idling speed varies over the A/F-ratio. As can be seen the diagram of FIG. 5 is similar to the diagram of FIG. 3. The left part of the diagram shows the engine having a rich mixture, i.e. the relative amount of fuel is comparably high, and the right part of the diagram shows the engine having a lean mixture, i.e. the relative amount of fuel is comparably low. When the engine speed N has its peak $N_{IDLE_MAX}$ the corresponding air-fuel mixture $A/F_{IDLE_MAX}$ is said to be neither rich nor lean; the engine has its optimum-power position. Moving from $A/F_{IDLE_MAX}$ towards a richer or leaner mixture provides for lower engine speeds N.

According to a preferred embodiment of the invention a first engine idle speed value $N_{IS1}$ and a second engine idle speed value $N_{IS2}$ provides an engine idle speed range [$N_{IS1}$, $N_{IS2}$]. The engine idle speed range [$N_{IS1}$, $N_{IS2}$] is preferably chosen to be lower than the maximum engine idle speed $N_{IDLE_MAX}$. However the interval could also be chosen as to include $N_{IDLE_MAX}$. In a similar fashion as the free speed control, the engine may be started with an idle speed rich fuel supply setting RS2 providing for a corresponding idle speed rich air-fuel mixture $A/F_{RS2}$. The engine idle speed range [$N_{IS1}$, $N_{IS2}$] could then quickly be sought by making the mixture leaner, i.e. by reducing the fuel supply gradually till the interval is reached. If the engine speed N becomes larger than the second idle speed value $N_{IS2}$ the fuel supply is preferably increased. However, in contrast to the free speed control, this interval is preferably sought each time the engine is idling, i.e. this is the normal engine control when the engine is idling corresponding to the test based control described in relation to FIG. 8.

Instead of using a idle speed range [$N_{IS1}$, $N_{IS2}$] a the first idle speed value $N_{IS1}$ could be used alone; as soon as the engine speed N is below the first idle speed value $N_{IS1}$ the fuel supply is decreased and if the engine speed N comes above the first idle speed value $N_{IS1}$ the fuel supply is increased, thereby adjusting the A/F ratio. Of course this has the effect that the fuel supply is adjusted very often, but since the idle speed is comparably low such frequent adjustments are possible. Thus whenever the engine speed N, during zero throttle, is lower than the idle speed value $N_{IS1}$, the fuel supply is fully stopped providing for a leaner mixture, and when the engine speed N exceeds the idle speed value $N_{IS1}$ the fuel supply is set to maximum fuel supply, enriching the mixture. Preferably this is done by having the shut-off valve 24 closed whenever the engine speed N is lower than the idle speed value $N_{IS1}$ and having the shut-off valve 24 opened whenever the engine speed exceeds the idle speed value $N_{IS1}$. Thereby the engine speed N will slightly vary around the idle speed value $N_{IS1}$.

Figure 6:
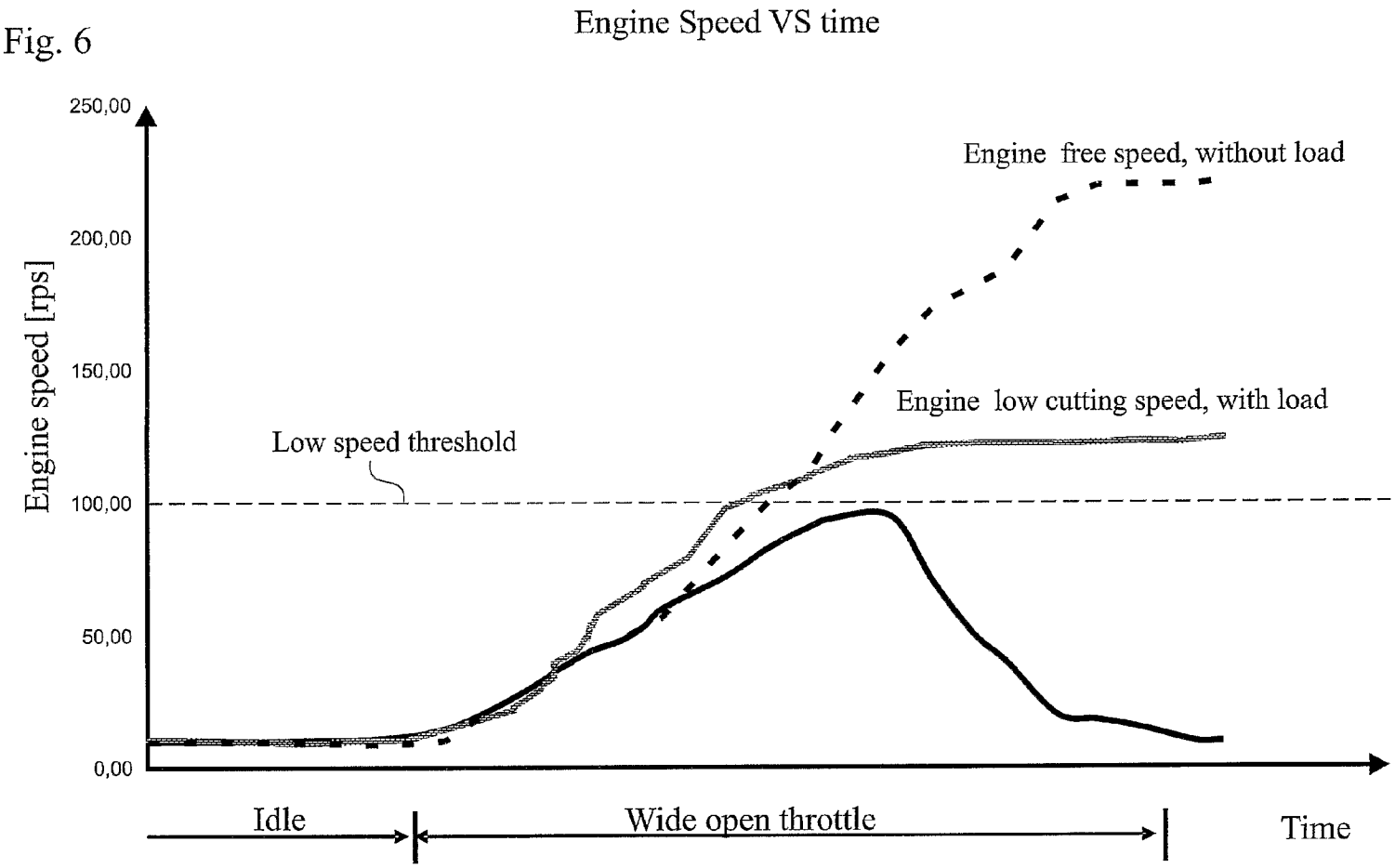
FIG. 6 illustrates three alternative situations for the development of the engine speed over time

FIG. 6 illustrates three alternative situations for the development of the engine speed over time. At first the engine is idling, i.e. zero throttle, but after a short time period the throttle is wide opened, i.e. full throttle. As can be seen in the diagram all three curves starts to rise after the throttle is set to full, the upper dotted line corresponds to the situation where the engine is free speeding without any load starting at a full throttle rich fuel setting RS1 and finally arriving within the engine speed interval [$N_{FS1}$, $N_{FS2}$]. The middle line corresponds to the situation when the engine is subjected for a working load and the engine finds an optimal A/F ratio for that load and a stable engine working speed. The lower line corresponds to the situation when the engine has started with an A/F ratio which is to lean.

In this situation the engine may very well operate when idling, but when the throttle is set to full the engine speed N will start to raise but fail to reach the engine working speed. This situation is of course undesirable. According to the invention there is provided a lean detection; detecting if the engine is running too lean. A lower work threshold LWT is set to 100 rps in the figure. Preferably the lower work threshold LWT is lower or equal to 120 rps, more preferably lower or equal to 100 rps. For the engine control system to detect if the engine is running lean several conditions must be fulfilled. According to the invention a first condition is that the engine throttle is full, a second condition is that the engine speed is below the lower work threshold LWT, a third condition is that the measured engine speed N has a negative trend, i.e. the engine speed is dropping, preferably the rate of dropping exceeds a predetermined threshold. It is further preferred that the lean detection is active only during a start up sequence of the engine. This start up sequence could be determined by a number of factors such as: 1) that the number of revolutions from start is lower than a first start up condition value, where preferably the first start up condition value is lower than 1000 revolutions, more preferably lower than 500 revolutions, even more preferred lower than 100 revolutions, 2) that the time from start is shorter than a second start up condition value, preferably the second start up condition value is in the range of 1-30 seconds, 3) that a number of separated full throttle indications from start are lower than a third start up condition value, 4) that an accumulated time of full throttle from start is shorter than a forth start up condition value. Thus the lean detection detects if the engine has a lean start setting of the fuel supply.

Figure 7:
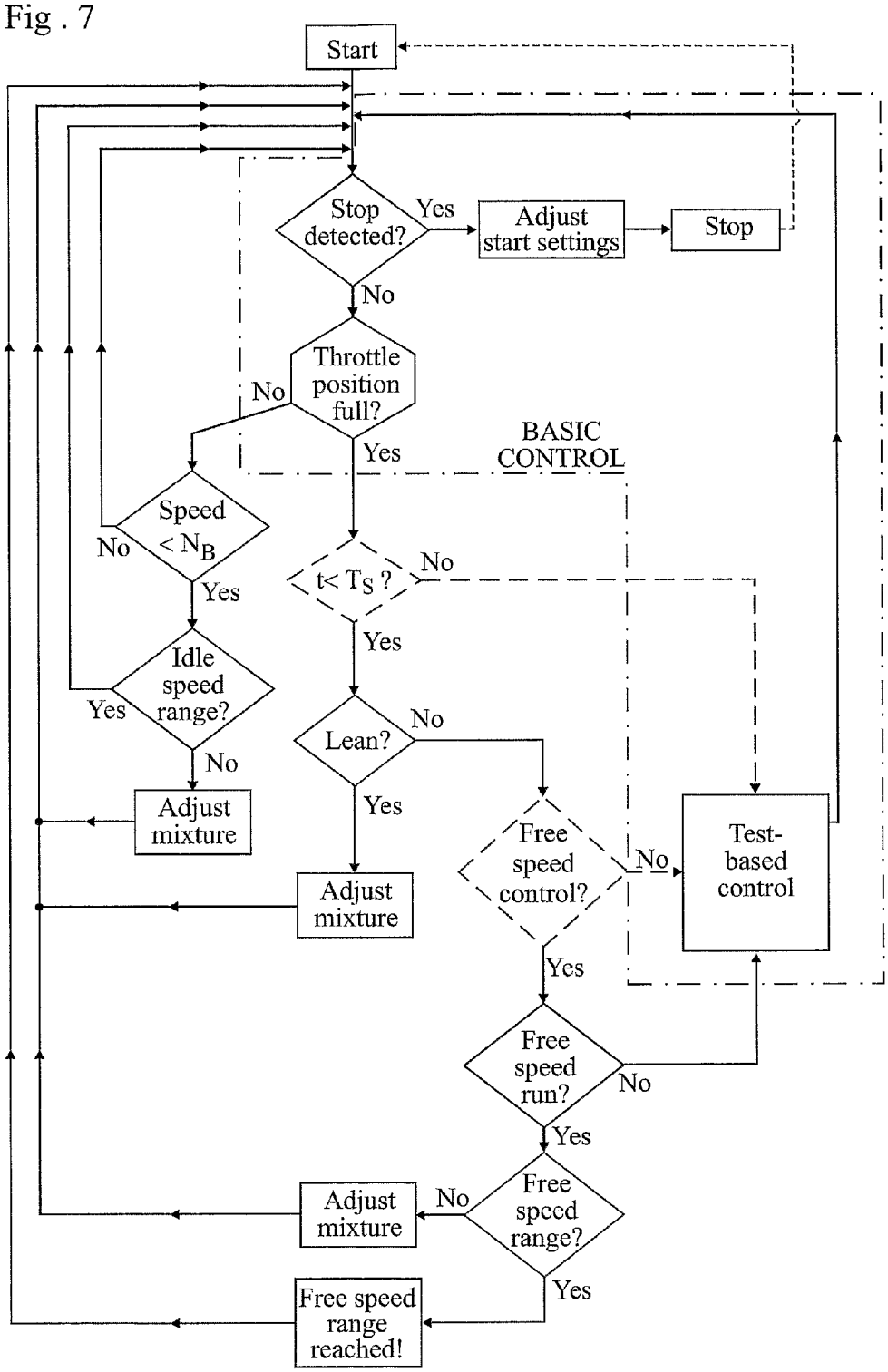
FIG. 7 is a flow chart indicating in principle the function of the control system in accordance with the invention.

FIG. 7 is a flow diagram indicating in principle the function of the control system in accordance with the invention. The control system is provided with an idling control active when the engine is idling, a free speed control preferably active during a start-up sequence, a basic control controlling the engine under working load. In the preferred embodiment the air-fuel mixture is adjusted by adjusting the fuel supply of the engine. The control system is preferably implemented in the control unit 9.

The first box in FIG. 7 relates to "engine start", which simply means that the engine is started. The engine is started with a rich fuel setting RS1, RS2, providing the engine 1 with an extra supply of fuel during the first cycles of revolutions. The rich fuel setting RS1, RS2 is dependent of the throttle position as described in relation to FIG. 3 and FIG. 5. Optionally the input from a temperature sensor TS could be used to affect the rich fuel settings RS1, RS2 but also to keep the rich fuel settings RS1, RS2 during a time period dependent of the temperature before the regulation of the fuel supply starts, i.e. if the temperature is very low the rich fuel settings RS1, RS2 could be further enriched and the engine could be kept at the rich fuel setting for a longer time before the regulation starts e.g. having a temperature of 0° C. the shut-off valve 24 could be fully opened during 1 second, having a temperature of −25° C. the shut-off valve 24 could be fully opened during 5 seconds. The next box in the flow chart is "Stop detected?" which detects if the engine is about to stop. This detection could be implemented in a number of ways, for instance if a stop button has been pressed or if an engine shut down is detected by a considerable decrease in the engine speed. If a stop is detected the control system of the engine may adjust the rich fuel start setting RS, RS2, for instance by saving the current fuel setting or by saving the current fuel setting plus an enrichment as the rich fuel start setting RS1, RS2, or any other start settings relating to the box "Adjust start settings". The box "stop" follows and the engine is stopped.

If no stop is detected, the next box following relates to "Throttle position full?". In the preferred embodiment a throttle position sensor is provided, detecting if the throttle position is full. Of course a more advanced sensors, or a number of simple sensors could be provided to detect further throttle position as zero throttle or intermediate throttle steps, but this would of course increase the costs.

If the box "Throttle position full?" provides the answer "no", the following box "Speed<$N_{IT}$" determines if the engine is idling. Since the box "Throttle position full?" only tells that the throttle position is full, the answer "no" could be any throttle position from zero up to full. According to the invention the A/F ratio is only adjusted for when the engine is either at full throttle or at zero throttle, when at intermediate throttle positions the fuel supply of full throttle is used. Zero throttle is detected by comparing the engine speed N with a predetermined idling threshold $N_{IT}$ and if the engine speed is below that value the engine is said to be idling. The predetermined idling threshold $N_{IT}$ is engine dependent, e.g. for a chainsaw an idling threshold $N_{IT}$ of around 3500 rpm could be used. If the engine speed N is above the idling threshold $N_{IT}$—no idling control is performed and the loop restarts above the box "stop detected?".

If the box "Speed<$N_{IT}$" provides the answer yes, i.e. the engine speed N is below the idling threshold $N_{IT}$, the following box "Idle speed range?" determines if the engine speed N is within the idle speed range [$N_{IS1}$, $N_{IS2}$]. If the engine speed N is outside the idle speed range [$N_{IS1}$, $N_{IS2}$] the air-fuel mixture is adjusted at the box "adjust mixture", preferably by adjusting the fuel supply. If the engine speed N is within the idle speed range [$N_{IS1}$, $N_{IS2}$] no adjustment is necessary and the loop restarts above the box "stop detected?".

If the box "Throttle position full?" provides the answer "yes", the following box "t<$T_S$?" is an optional box limiting the lean detection and the free speed control to an start up sequence. A start up sequence threshold $T_S$ could be e.g. be expressed as the predetermined time in seconds from the start of the engine or as a predetermined number of revolutions from the engine start, e.g. $T_S$=100 revolutions. If the time or number of revolutions is equal or larger to the start up sequence threshold $T_S$ the engine is controlled by the basic engine control relating to the box "Test based control".

The next box in the flow chart relates to the box "Lean?", following the optional box "t<$T_S$?". The "Lean?" box determines if the engine is running too lean, i.e. the box engine speed N is drastically dropping even if the engine throttle is full. Provided a "yes" the box "adjust mixture" follows where the air-fuel mixture is enriched preferably by increasing the fuel supply of the engine, where after the loop restarts above the box "stop detected?". The lean detection conditions are described above in relation to FIG. 5.

Provided a "no" the next box following is the optional box "Free speed control?". In this step the control method determines if there need to be any further free speed control. This box may include the condition of the optional box "t<$T_S$?" described above, provided that the optional box "t<$T_S$?" is not used before the "Lean?" box. It may also separately or combined with the condition of the optional box "t<$T_S$?" include a condition determining if the free speed range [$N_{FS1}$, $N_{FS2}$] has been achieved prior since the start of the engine. If the free speed range [$N_{FS1}$, $N_{FS2}$] has been achieved prior there is no need for the rough regulation of the free speed control, but rather the "test based control" of the "basic control" can be utilised. Thus if the box "free speed control?" provides the answer "no" the "test based control" box follows.

Provided a "yes" the following box relates to "free speed run?" which determines if the engine speed N is above a free speed threshold $N_{FT}$, preferably above 10000 rpm, for a time period of e.g. 1 s or a number of revolutions. This threshold is to determine that the engine is running without load, i.e. if the engine is free speeding. Provided a "no" the box "test based control" follows, but provided a "yes" the box "free speed range" follows.

The box "free speed range?" determines if the engine speed N is within the free speed range [$N_{FS1}$, $N_{FS2}$]. If the engine speed N is within the range, the box "Set free speed fuel setting" follows, but if the engine speed is outside the range the box "adjust mixture" follows where the air-fuel mixture is adjusted preferably by adjusting the fuel supply of the engine. This procedure is described I n relation to FIG. 3. After the box "adjust mixture" the loop restarts above the box "stop detected?".

The box "Free speed control finished!" follows next. If the free speed range has been achieved during an engine run there is no need to perform this rough regulation further during the present engine run, i.e. the engine has found a feasible AS/F ratio for this engine run. It is now up to the "test based control" of the basic control to fine tune the A/F ratio. After the box "Free speed control finished!" the loop restarts above the box "stop detected?".

Figure 8:
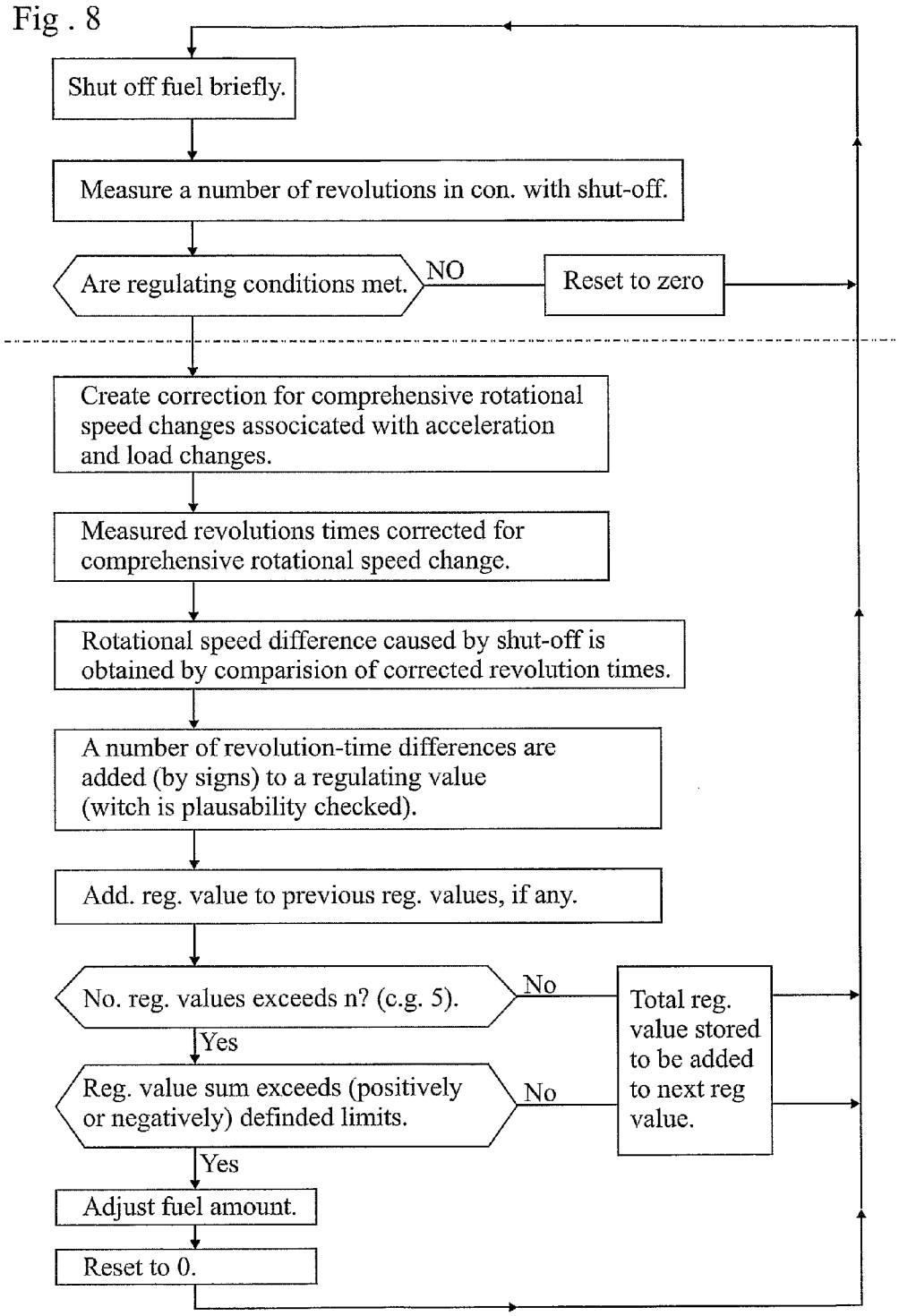
FIG. 8 is a flow chart over the basic control of the engine.

The box "Test based control" relates to a fine tuning control method of the A/F ratio described in relation to FIG. 8. The basic control loop includes the box "Test based control" as well as "Throttle position full?" and "Stop detected".

FIG. 8 is a flow chart relating to a test based control. The test based control relates to the control of a power saw engine, an engine application that is quite demanding from a control point of view. Its operational conditions are characterized by rapid load variations and rapid acceleration changes. This leads to frequent variations of the rotation speeds. In many other engine applications such variations are very infrequent, for instance in the case of aircraft and ship engines. The power saw engine is usually a two stroke engine of the type that is carburettor supplied and crank case scavenged. This means that the brief-change of the mixture ratio, i.e. the A/F-ratio, preferably is effected by means of a brief shut-off of the fuel supply over one or a couple of engine revolutions. If the engine is running lean, the engine speed will temporally drop during a number of revolutions a short while after the brief change and if the engine is running rich the engine speed will temporally increase during a number of revolutions a short while after the brief change, and hence this information can be used to decide if the A/F ratio should be adjusted towards lean or rich. In other engine designs the fuel can instead be partly shut-off. In a direct injection engine every injection will instead be shortened, i.e. partly shut-off. The method of testing if the engine is lean or rich by brief shut-off of the fuel supply over several engine revolutions is thoroughly described in EP0715686 and will be described in a more general manner below.

In view of the above, the flow chart of FIG. 8 will be followed. The first box in FIG. 8 relates to "shut-off fuel briefly". The shut-off applies to engine revolutions 96, 97, 98 and 99 in the previous control period, each control period comprising 100 revolutions, preceding the discussed one. The next box is labelled "measure a number of revolution times in connection with shut off". A number of engine revolution times are measured. The revolution times relate to engine rotational speeds chosen in such a manner that at least one revolution of the engine is unaffected by the change, preferably an engine rotational speed that is sufficiently early for the A/F-ratio change not having had time to affect the engine rotational speed. In principle, also a later engine revolution could be chosen, but this would make it considerably more difficult to correct the revolution times to achieve the over all change of the rotational speed as indicated below. At least one revolution of the engine is chosen in such a manner that it is affected by the brief A/F-ratio change.

The next box in the flow chart, FIG. 8 is, "Are regulating conditions met?". At this stage there is only one condition to be met, viz. to establish whether the rotational speed is within the regulating limit, in this case 120-200 rps, i.e. 7200-12000 revolutions per minute. If this is the case, the program is run through further in the direction towards adjustment of the A/F-ratio. If this is not the case, revolutions and revolution times are reset to zero, i.e. the measured revolution times are dumped. The process is run through again and this continues until the rotational speed is within the regulating limit.

Immediately below the line in FIG. 8 appears the box entitled, "create correction for comprehensive rotational-speed changes associated with acceleration and load changes". If working load changes the engine speed will be affected, this box concerns separating engine speed changes due to load changes from the engine speed changes dependent of the brief change of the mixture ratio. This can be done by a first measuring the engine speed at the first revolution in the control period, unaffected by the brief change of the A/F ratio, and secondly measuring the engine speed at the end of the control period where the engine speed has been given time to stabilize after the brief change of the mixture. These two values are divided by the number of revolutions in between thereby providing a derivate of the engine speed trend during that particular control period.

The following box "Measured revolution times corrected for comprehensive rotational-speed change" adjust the measured revolutions times of the box "measure a number of revolution times in connection with shut off" accordingly with the results of the preceding box "create correction for comprehensive rotational-speed changes associated with acceleration and load changes". The next box "Rotational-speed difference caused by shut-off is obtained by comparison of corrected revolution times" calculates how the engine speed changed due to the brief change of the mixture ratio, compensated for the comprehensive rotational-speed changes, if any.

The next box following is "Determining a regulation value based on revolution time differences". A regulation value is determined based on the revolution time differences from the box "Rotational-speed difference caused by shut-off is obtained by comparison of corrected revolution times".

The next box is "Add regulating value to previous regulating values if any". Each regulating value is associated with a certain brief change of the mixture ratio. By adding together several regulating values a computation of some kind of average values is made from several different changes of mixture ratios. In the following box the question is raised whether the number of regulated values exceeds n (e.g. 5). This means that the number of average values is conditional, i.e. the number of regulating values included in the total regulating value. The larger the number of regulating values, the safer the average value computation. When the number of average values is less than 5 the total regulating value is stored to be added to the next regulating value. The next regulating value is obtained when the hitherto part of the chart has been run through once more.

On the other hand, when the total regulating value contains more than 5 regulating values a comparison is made between its size and certain limit values in box "Total regulating value>highest regulating limit or total regulating value<lowest regulating limit?". Since the regulating values and the total regulating value also contain signs, it is important that these two limit values be compared. A positive total regulating value thus should exceed the highest regulating limit whereas a negative total regulating value should be less than the lowest regulating limit. For example, in the present case the highest regulating limit is set to 1500 and the lowest regulating limit to −750. If the total regulating value does not exceed either of the given limit values the total regulating value is stored to be added to the following regulating value and the process is run through again to add another regulating value to the sum.

If on the other hand a total of regulating value exceeds the nearest limit value, the answer is YES. This leads to box "Adjust fuel amount". Difference between total regulating value and regulating limit defines an amount of change of the fuel addition and the sign defines the direction, i.e. against leaner or richer mixture ratio. In this case a comparison is made between the difference between the total regulating value and the nearest regulating limit. The sign of the difference defines in which direction the adjustment is to be made. Thus, the adjustment is made in the direction towards a more suitable mixture ratio, richer or leaner. Obviously, this is important in order to obtain a well functioning regulating process. The difference size defines the amount of the mixture ratio change, which is the amount of adjustment required. The result is some kind of need-control adjustment, which is an advantage, although not completely necessary. For example, instead an adjustment by a predetermined amount in the right direction could be made. In this case, an adjustment of the fuel amount has been made, i.e. an adjustment of the A/F-ratio. Thereafter, the total regulating value and the number of average values are set to zero. The number of revolutions has already been set to zero. The process is then repeated.

The fundamentally important principles of the control are on the one hand to provide safety through average-value computation and on the other to correct for comprehensive rotational-speed changes and on the other to perform a plausibility check. The average-value computation is effected in several steps. Firstly, four different difference values between different revolution times within each cycle, i.e. engine revolutions 0-100 are used. Then at least five regulating values are added before a comparison is made with predetermined regulating limits. Each regulating value is associated with one cycle and its input regulating times are corrected for comprehensive rotational-speed changes. The number of regulating values that are compared with the regulating limits thus is not fixed upwards. This means that when the engine is running well, i.e. has a suitable A/F-ratio, a large number of regulating values, for example 10, probably are required before the total regulating value exceeds a regulating limit. In this case, it is also likely that the excess is moderate. This means that a small adjustment of the fuel amount is made. On the other hand, if the A/F-ratio value is not very satisfactory each regulating value will be high and already at five regulating values the total regulating value highly exceeds the regulating limit. This means that a large correction is effected in the right direction. The examples clearly show the advantages of this control philosophy.

Whereas the invention has been shown and described in connection with the preferred embodiment thereof it will be understood that many modifications, substitutions, and additions may be made which are within the intended broad scope of the following claims. From the foregoing, it can be seen that the present invention accomplishes at least one of the stated objectives.

For an crank case scavenged engine e.g. in a chainsaw the first engine free speed value $N_{FS1}$ is preferably larger than 11000 rpm, more preferably larger than 12000 rpm and even more preferred larger than 13000 rpm. Further it is preferably lower than 16000 rpm, more preferably lower than 15000 rpm and even more preferred lower than 14000 rpm. However for engines in different machines such as lawn movers or power cutters the free speed values could be different.

For an engine idling, it is preferred that the first engine idle speed value $N_{IS1}$ is larger than 2000 rpm, preferably larger than 2200 rpm, more preferably larger than 2300 rpm. And further it is preferred that the first engine idle speed value $N_{IS1}$ is less than 3200 rpm, preferably less than 3000 rpm, more preferably less than 2700 rpm. However, these values are also engine dependent as mentioned for the engine free speed.

Since the engine speed in a two-stroke crankcase scavenged engine normally fluctuates considerably from revolution to revolution, it is desirable that the free speed range [$N_{FS1}$, $N_{FS2}$] as well as the idle speed range [$N_{IS1}$, $N_{IS2}$] are not too short; in order to arrive at a stable fuel supply. Therefore the second engine free speed value $N_{FS2}$ is preferably between 10-500 rpm larger than the first engine free speed value $N_{FS1}$, preferably 100-200 rpm larger, and the second engine idle speed value $N_{IS2}$ is preferably between 10-500 rpm larger than the first engine idle speed value $N_{IS1}$, preferably 100-200 rpm larger.

Further, instead of a using a free speed range [$N_{FS1}$, $N_{FS2}$], the first engine free speed value $N_{FS1}$ could be used alone. I.e. by gradually decreasing the fuel supply from the full throttle rich fuel setting RS1 the engine speed N increases and as soon as the engine speed N is higher or equal to the first engine free speed value $N_{FS1}$; the engine free speed is said to have been reached and the corresponding fuel setting is stored in the control unit. Observe that this differs from the use of a single idle speed value $N_{IS1}$ as described in relation to FIG. 5.

Further, the free speed control described in relation to FIG. 3 and FIG. 7, the calibration mode described in relation to FIG. 3, the idle speed control described in relation to FIG. 5 and FIG. 7, the lean prevention control described in relation to FIG. 6 and FIG. 7 as well as the basic control described in relation to FIG. 7 and FIG. 8 could all be used independently of each other as well as in different combinations.

Further, the calibration mode described above in relation to a chainsaw could be implemented in other hand held working machines comprising a centrifugal clutch and a cutting tool which can be blocked from moving.

What is claimed is:

1. Method for adjusting an air-fuel ratio of an internal combustion engine, in a fuel supply section, the fuel supply section comprising a control unit for adjusting the air-fuel ratio of the engine, the engine having an engine speed and an engine throttle ranging from zero throttle to full throttle, the method comprising the steps of:

a) measuring the engine speed of the engine;

b) comparing the engine speed to a first engine speed value;

c) adjusting the air-fuel ratio if the engine speed is lower than the first engine speed value, wherein the engine is crankcase scavenged, such that at least a part of the air needed for the engine is crankcase scavenged; and d) repeating the above elements a) to c) until the engine speed is either greater than or equal to the first engine speed value.

2. The method according to claim 1, further comprising the steps of:

e) comparing the engine speed to a second engine speed value, the second engine speed value arranged to be larger than the first engine speed value;

f) adjusting the air-fuel ratio if the engine speed is higher than the second engine speed value; and g) repeating the elements a) to step f) until the engine speed is in the range of the first and second engine speed values.

3. The method according to claim 1, wherein the engine uses a rich fuel setting when started, the rich fuel setting providing a rich start air-fuel ratio that is richer than a first engine air-fuel ratio corresponding to the first engine speed value.

4. The method according to claim 3, wherein the rich fuel setting is based on a stored predetermined fixed first setting value.

5. The method according to claim 3, wherein the rich fuel setting is based on a stored variable second setting value, the second setting value being adapted from at least the latest engine run.

6. The method according to claim 3, wherein adjusting the air-fuel ratio in element c) is performed by increasing the air-fuel ratio.

7. The method according to claim 3, wherein adjusting the air-fuel ratio in element f) is performed by decreasing the air-fuel ratio.

8. The method according to claim 1, wherein adjusting the fuel ratio is performed by adjusting the fuel supply of the engine.

9. The method according to claim 1, wherein measuring the engine speed is by averaging the engine speed over at least two engine revolutions.

10. The method according to claim 2, wherein the second engine speed value is between 10-500 rpm greater than the first engine speed value.

11. The method according to claim 10, wherein the first engine speed value is greater than 11000 rpm.

12. The method according to claim 10, wherein the first engine speed value is less than 16000 rpm.

13. The method according to claim 10, wherein the first and second engine speed values are set to be lower than a maximum engine speed value, thereby also enabling an overspeed control, where the maximum engine speed value is defined as the engine speed when the engine is running at an optimized air-fuel ratio for maximum engine speed.

14. The method according to claim 1, further comprising controlling a first idle speed by determining an idle speed air-fuel ratio.

15. The method according to claim 1, further comprising controlling a second idle speed by determining an idle speed air-fuel ratio, wherein the second engine speed value is equal to the first engine speed value.

16. The method according to claim 14, wherein said controlling of the idle speed is performed when the engine throttle is at zero throttle.

17. The method according to claim 14, wherein the first engine speed value is larger than 2000 rpm.

18. The method according to claim 14, wherein the first engine speed value is less than 3200 rpm.

19. The method according to claim 1 further comprising performing a lean prevention control, where the engine is considered running lean if at least the following conditions are met: 1) the engine throttle is full throttle, 2) the measured engine speed is lower than a lower work threshold and 3) a trend of the measured engine speed is decreasing.

20. The method according to claim 19, wherein the trend of the measured engine speed is derived over a number of engine revolutions within the interval 2-100 engine revolutions.

21. The method according to claim 19, wherein performing the lean prevention control is active only during a start up sequence of the engine, the start up sequence determined by at least one of the following conditions: 1) that a number of engine revolutions from start is lower than a first start up condition value, 2) that a start time from start is shorter than a second start up condition value, 3) that a number of separated full throttle indications from start are lower than a third start up condition value, or 4) that an accumulated time of full throttle from start is shorter than a fourth start up condition value.

22. The method according to claim 1, wherein the engine is crankcase scavenged such that at least a part of the air and lubricant needed for the engine is crankcase scavenged.

23. The method according to claim 1, wherein at least a part of the fuel needed for the engine is also crankcase scavenged.

24. The method according to claim 1, further comprising the step of performing a free speed control if the engine throttle is full throttle and the measured engine speed is larger than a free speed threshold.

25. The method according to claim 24, wherein the free speed control is also performed if the engine speed has not, during the ongoing present engine run, fulfilled a plurality of free speed regulating conditions.

26. The method according to claim 1, wherein the internal combustion engine is in a handheld working tool and further comprises a centrifugal clutch that drives a cutting device and wherein the method further comprises the step of calibrating engine settings.

27. The method of claim 26, wherein calibrating engine settings further includes:

blocking the cutting device;

starting the engine; and activating the engine full throttle at least two separate times providing for at least two engine full throttle indications within a predetermined time period.

28. The method according claim 26, wherein the hand held working tool is a chainsaw and the step of blocking the cutting device is performed by activating a chain brake.

29. An internal combustion engine comprising:

a fuel supply section comprising a control unit for adjusting an air-fuel ratio of the engine;

an engine throttle in communication with the fuel supply section; and the control unit for adjusting the air-fuel ratio configured to have a routine to:

measure the engine speed of the engine;

compare the engine speed to a first engine speed value; and adjust the air-fuel ratio if the engine speed is lower than the first engine speed value;

said control unit repeating said routine until the engine speed is either greater than or equal to the first engine speed value;

wherein the engine is crankcase scavenged such that at least a part of the air needed for the engine is crankcase scavenged.

30. An internal combustion engine of claim 29, wherein the engine is chosen from the group comprising: a two-stroke engine and a four-stroke engine.

31. A method for engine control comprising:

running a test based control essentially defined by a brief fuel shut-off and a measurement of a number of engine revolutions in connection with the brief shut-off;

adjusting a fuel amount based on the effect of the brief shut-off, the adjustment performed after an aggregation of a plurality of shut-offs; and combining the test based control with at least one of the following control methods: a free speed control method, an idle speed control, or a lean prevention control method;

wherein the engine is crankcase scavenged such that at least a part of the air needed for the engine is crankcase scavenged.

32. Method for adjusting an air-fuel ratio of an internal combustion engine, in a fuel supply section, the fuel supply section comprising a control unit for adjusting the air-fuel ratio of the engine, the engine having an engine speed and an engine throttle ranging from zero throttle to full throttle, the method comprising the steps of:

a) measuring the engine speed of the engine;

b) comparing the engine speed to a first engine speed value;

c) adjusting the air-fuel ratio if the engine speed is lower than the first engine speed value; and d) repeating the above elements a) to c) until the engine speed is either greater than or equal to the first engine speed value e) comparing the engine speed to a second engine speed value, the second engine speed value arranged to be larger than the first engine speed value;

f) adjusting the air-fuel ratio if the engine speed is higher than the second engine speed value; and g) repeating the elements a) to step f) until the engine speed is in the range of the first and second engine speed values.

33. Method for adjusting an air-fuel ratio of an internal combustion engine, in a fuel supply section, the fuel supply section comprising a control unit for adjusting the air-fuel ratio of the engine, the engine having an engine speed and an engine throttle ranging from zero throttle to full throttle, the method comprising the steps of:

a) measuring the engine speed of the engine;

b) comparing the engine speed to a first engine speed value;

c) adjusting the air-fuel ratio if the engine speed is lower than the first engine speed value; and d) repeating the above elements a) to c) until the engine speed is either greater than or equal to the first engine speed value; wherein the engine uses a rich fuel setting when started, the rich fuel setting providing a rich start air-fuel ratio that is richer than a first engine air-fuel ratio corresponding to the first engine speed value.

* * * * *